US009845920B2

(12) United States Patent
Brouqueyre et al.

(10) Patent No.: US 9,845,920 B2
(45) Date of Patent: Dec. 19, 2017

(54) DEFROSTER FOR OXYGEN LIQUEFIER

(75) Inventors: Laurent Brouqueyre, Kennesaw, GA (US); Brian Edward Dickerson, Canton, GA (US)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 776 days.

(21) Appl. No.: 14/004,910

(22) PCT Filed: Mar. 9, 2012

(86) PCT No.: PCT/IB2012/051115

§ 371 (c)(1),
(2), (4) Date: Sep. 13, 2013

(87) PCT Pub. No.: WO2012/123872

PCT Pub. Date: Sep. 20, 2012

(65) Prior Publication Data

US 2014/0000289 A1 Jan. 2, 2014

Related U.S. Application Data

(60) Provisional application No. 61/452,206, filed on Mar. 14, 2011.

(51) Int. Cl.
*F25J 1/00* (2006.01)
*F17C 13/10* (2006.01)
(Continued)

(52) U.S. Cl.
CPC ..... *F17C 13/10* (2013.01); *F25J 1/0017* (2013.01); *F25J 1/0204* (2013.01); *F25J 1/0248* (2013.01);
(Continued)

(58) Field of Classification Search
CPC ..... F25J 1/0017; F25J 1/0248; F25J 1/0204; F25J 2205/40; F25J 2205/64; F25J 2210/40; F25J 2210/50; F25J 2215/50; F25J 2215/52; F25J 2215/54; F25J 2215/56; F17C 2250/0443; F17C 2270/025; F24F 2011/0054; F24F 2011/0087
See application file for complete search history.

(56) References Cited

U.S. PATENT DOCUMENTS 4,496,376 A 1/1985 Hradek
4,831,833 A * 5/1989 Duenes ..... F25D 21/02 62/140
(Continued)

FOREIGN PATENT DOCUMENTS

CN 1649646 A 8/2005
WO WO03092817 A1 11/2003
(Continued)

OTHER PUBLICATIONS

Ahmet Unal; "Theoretical Analysis of Triple Concentric-Tube Heat Exchangers Part 2: Case Studies"; 2001; Int. Comm. Heat Mass Transfer vol. 28, No. 2 pp. 243-256.*

*Primary Examiner* — Keith Raymond
(74) *Attorney, Agent, or Firm* — Michael W. Haas

(57) ABSTRACT

An oxygen liquefier system may be configured to defrost an oxygen line included therein. The system may include one or more sieve beds, a liquid oxygen reservoir, an oxygen line, a controller, a heating apparatus, and/or other components. The one or more sieve beds are configured to extract oxygen from air obtained from an ambient environment. The liquid oxygen reservoir is configured to store oxygen extracted at the one or more sieve beds that has been liquefied. The oxygen line is configured to provide fluid communication between the one or more sieve beds and the liquid oxygen reservoir. The controller is configured to detect a blockage caused by frozen liquid within the oxygen line based on a liquid oxygen production rate. The heating apparatus is configured to defrost the oxygen line to melt frozen liquid within the oxygen line responsive to the detection of the blockage.

18 Claims, 3 Drawing Sheets

(51) Int. Cl.
*F25J 1/02* (2006.01)
*F28F 1/02* (2006.01)

(52) U.S. Cl.
CPC ..... *F25J 1/0262* (2013.01); *F17C 2221/011* (2013.01); *F17C 2250/0443* (2013.01); *F17C 2270/025* (2013.01); *F25J 2205/40* (2013.01); *F25J 2205/60* (2013.01); *F25J 2210/40* (2013.01); *F25J 2245/40* (2013.01); *F25J 2290/44* (2013.01); *F28F 1/022* (2013.01)

(56) References Cited

U.S. PATENT DOCUMENTS

| | | | | |
|---|---|---|---|---|
| 6,698,423 | B1 | 3/2004 | Honkonen | |
| 2003/0066636 | A1* | 4/2003 | Kawakubo | F25B 40/00 165/164 |
| 2004/0050095 | A1* | 3/2004 | Brigham | F25J 3/04254 62/643 |
| 2004/0244585 | A1 | 12/2004 | Meckes | |
| 2007/0183902 | A1* | 8/2007 | Stiles, Jr. | F04B 49/20 417/42 |
| 2008/0251241 | A1* | 10/2008 | Yusa | F28D 7/106 165/154 |
| 2009/0020015 | A1* | 1/2009 | Sermet | A61M 16/10 96/221 |
| 2010/0300665 | A1* | 12/2010 | Denoual | F25B 40/00 165/164 |

FOREIGN PATENT DOCUMENTS

| | | | |
|---|---|---|---|
| WO | WO2004015347 | A2 | 2/2004 |
| WO | WO2006052818 | A2 | 5/2006 |

* cited by examiner

DEFROSTER FOR OXYGEN LIQUEFIER

CROSS-REFERENCE TO RELATED APPLICATIONS

This patent application claims the priority benefit under 35 U.S.C. §371 of international patent application no. PCT/IB2012/05115, filed Mar. 9, 2012, which claims the priority benefit under 35 U.S.C. §119(e) of U.S. Provisional Application No. 61/452,206 filed on Mar. 14, 2011, the contents of which are herein incorporated by reference.

BACKGROUND OF THE INVENTION

1. Field of the Invention

The present disclosure pertains to defrosting a component of an oxygen liquefier, and, in particular, defrosting an oxygen line in an oxygen concentrator and liquefier system to remove a whole or partial blockage caused by frozen liquid, such as water, within the oxygen line.

2. Description of the Related Art

It is well known to liquefy oxygen and other gases. Many gases can be put into a liquid state at normal atmospheric pressure by simple cooling; a few, such as carbon dioxide, require pressurization as well. Some gas liquefiers typically rely on the absence of moisture in the gas to be liquefied. Some of the standard techniques used to remove moisture include the use of membranes, adsorption, absorption, and/or cryogenic distillation.

However, oxygen coming directly from a standard pressure swing adsorption (PSA) system used as an oxygen concentrator may still contain trace amounts of moisture. In some instances, for example, the trace amounts of moisture may have a dew point of approximately −60° C. As a result, ice may form within gas lines during liquefaction of oxygen coming from a PSA system, thus restricting or blocking oxygen flow and/or acting as an insulator reducing heat exchange efficiency.

SUMMARY OF THE INVENTION

Accordingly, it is an aspect of one or more embodiments to provide a method for operating an oxygen concentrator and liquefier system. The method includes extracting oxygen from air obtained from an ambient environment using one or more sieve beds. The method includes transferring oxygen extracted at the one or more sieve beds to a liquid oxygen reservoir via an oxygen line. The oxygen extracted at the one or more sieve beds is liquefied between the one or more sieve beds and the liquid oxygen reservoir. The method includes defrosting the oxygen line to melt frozen liquid within the oxygen line.

It is yet another aspect of one or more embodiments to provide an oxygen concentrator and liquefier system configured to defrost one or more oxygen lines included therein. The system includes one or more sieve beds, a liquid oxygen reservoir, an oxygen line, and a heating apparatus. The one or more sieve beds are configured to extract oxygen from air obtained from an ambient environment. The liquid oxygen reservoir is configured to store oxygen extracted at the one or more sieve beds that has been liquefied. The oxygen line is configured to provide fluid communication between the one or more sieve beds and the liquid oxygen reservoir. The heating apparatus is configured to defrost the oxygen line to melt frozen liquid within the oxygen line.

It is yet another aspect of one or more embodiments to provide an oxygen concentrator and liquefier system configured to defrost oxygen communication means included therein. The system includes extraction means, storage means, oxygen communication means, and heating means. The extraction means is for extracting oxygen from air obtained from an ambient environment. The storage means is storing oxygen extracted at the extraction means that has been liquefied. The oxygen communication means is for providing fluid communication between the extraction means and the storage means. The heating means is for defrosting the oxygen communication means to melt frozen liquid within the oxygen communication means.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention.

DETAILED DESCRIPTION OF EXEMPLARY EMBODIMENTS

Figure 1:
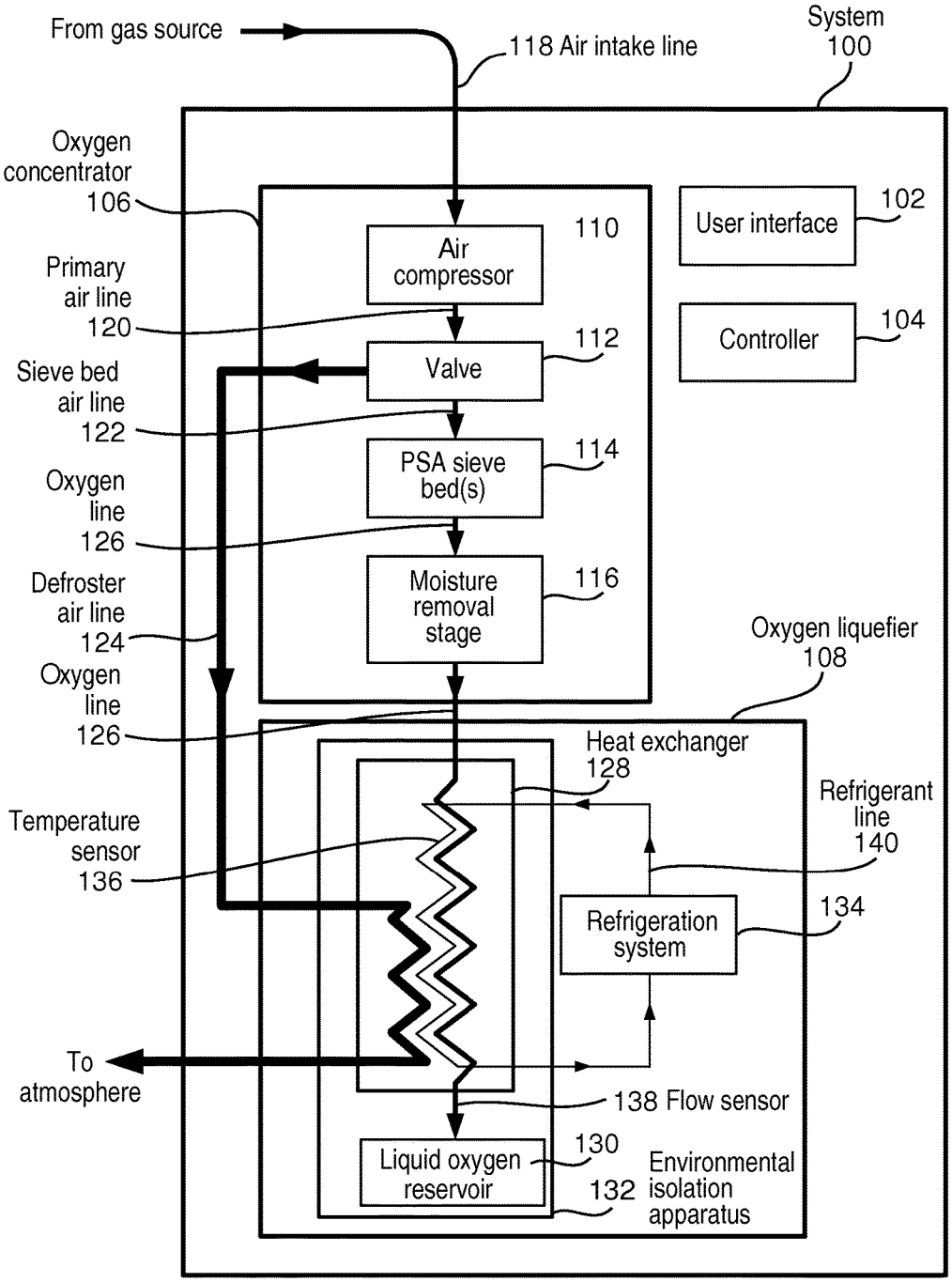
FIG. 1 is a block diagram illustrating a system configured for oxygen concentration and liquefaction, in accordance with one or more embodiments.

As used herein, the singular form of "a", "an", and "the" include plural references unless the context clearly dictates otherwise. As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other.

As used herein, the word "unitary" means a component is created as a single piece or unit. That is, a component that includes pieces that are created separately and then coupled together as a unit is not a "unitary" component or body. As employed herein, the statement that two or more parts or components "engage" one another shall mean that the parts exert a force against one another either directly or through one or more intermediate parts or components. As employed herein, the term "number" shall mean one or an integer greater than one (i.e., a plurality).

Directional phrases used herein, such as, for example and without limitation, top, bottom, left, right, upper, lower, front, back, and derivatives thereof, relate to the orientation of the elements shown in the drawings and are not limiting upon the claims unless expressly recited therein.

FIG. 1 is a block diagram illustrating a system 100 configured for oxygen concentration and liquefaction, in accordance with one or more embodiments. As depicted in FIG. 1, system 100 includes a user interface 102, a controller 104, an oxygen concentrator 106, an oxygen liquefier 108, and/or other components. The description of system 100 is illustrative and not intended to be limiting. For example, system 100 may include additional components not necessary to describe the present technology. Additionally, while the present technology is describe in the context of an oxygen concentration and liquefaction system, the concepts can be applied to other types of gas liquefaction systems (e.g., a nitrogen liquefaction system).

User interface 102 is configured to provide an interface between system 100 and a user through which the user may provide information to and receive information from system 100. This enables data, results, and/or instructions and any other communicable items, collectively referred to as "information," to be communicated between the user and system 100. As used herein, the term "user" can refer to a single individual or a group of individuals who may be working in coordination. Examples of interface devices suitable for inclusion in user interface 102 include a keypad, buttons, switches, a keyboard, knobs, levers, a display screen, a touch screen, speakers, a microphone, an indicator light, an audible alarm, and a printer. In one embodiment, user interface 102 actually includes a plurality of separate interfaces.

It is to be understood that other communication techniques, either hard-wired or wireless, are also contemplated as user interface 102. For example, user interface 102 may be integrated with a removable storage interface provided by electronic storage. In this example, information may be loaded into system 100 from removable storage (e.g., a smart card, a flash drive, a removable disk, etc.) that enables the user(s) to customize the implementation of system 100. Other exemplary input devices and techniques adapted for use with system 100 as user interface 102 include, but are not limited to, an RS-232 port, RF link, an IR link, modem (telephone, cable or other). In short, any technique for communicating information with system 100 is contemplated for user interface 102.

Controller 104 is configured to provide information processing capabilities in system 100. Controller 104 may be communicatively coupled with one or more components of system 100. Controller 104 may be configured to control the operation of one or more components of system 100 and/or the coordination therebetween. As such, controller 104 may include one or more of a digital processor, an analog processor, a digital circuit designed to process information, an analog circuit designed to process information, a state machine, and/or other mechanisms for electronically processing information. In some embodiments, controller 104 includes and/or is communicatively coupled to electronic storage media configured to store instructions executable by controller 104. Although controller 104 is shown in FIG. 1 as a single entity, this is for illustrative purposes only. In some implementations, controller 104 may include a plurality of processing units. These processing units may be physically located within the same device or computing platform, or controller 104 may represent processing functionality of a plurality of devices operating in coordination.

Oxygen concentrator 106 is configured to generate gas having an elevated oxygen content (e.g., 93% pure medical grade oxygen) from ambient air (approximately 78% nitrogen, 21% oxygen, 0.93% argon, 0.038% carbon dioxide, and small amounts of other gases), gas from a gas cylinder, and/or any other gas source. In the embodiment depicted in FIG. 1, oxygen concentrator 106 includes a gas compressor 110, a valve 112, one or more pressure swing adsorption (PSA) sieve beds 114, a moisture removal stage 116, and/or other components. The description of oxygen concentrator 106 is illustrative and not intended to be limiting. For example, oxygen concentrator 106 may include additional components not necessary to describe the present technology, such a product thanks, pressure relieve valves, and filters. Additionally, while the present technology is describe in the context of a pressure swing adsorption system, the concepts can be applied to other types of gas concentrators, such as ceramic and distillation type of oxygen generation systems.

Compressor 110 is configured to provide gas at an elevated pressure relative to atmosphere. The gas (e.g., air) is obtained by gas compressor 110 from a gas source (e.g., ambient environment). Gas is introduced to gas compressor 110 via an air intake line 118. Gas compressor 110 provides pressurized gas via a primary air line 120. By way of non-limiting example, gas compressor 110 may include one or more of a piston-type compressor, a rotary screw compressor, a vane compressor, a centrifugal compressor, and/or other devices configured to provide gas at an elevated pressure relative to atmosphere. According to some embodiments, pressurized gas provided by gas compressor 110 has an elevated temperature, relative to gas obtained via air intake line 118, due to gas compression performed by gas compressor 110. For example, pressurized gas provided by gas compressor 110 may have a temperature of approximately 80° C. to 90° C., depending on the temperature of gas obtained via air intake line 118.

Valve 112 is configured to wholly or partially redirect received gas between two or more components of system 100. As depicted in FIG. 1, valve 112 receives pressurized gas from gas compressor 110 via primary air line 120. During normal operation, i.e., generation of gas having high oxygen content, valve 112 directs pressurized gas to PSA sieve beds 114 via at least one sieve bed air line 122. While defrosting one or more gas lines of system 100, valve 112 directs pressurized gas to a defroster air line 124. By way of non-limiting example, valve 112 may be controlled by hydraulic, pneumatic, manual, solenoid, motor, and/or other techniques suitable for controlling valve 112 to redirect gas. In some embodiments, controller 104 directs valve 112 to redirect gas. Such redirection may be responsive to detection of a whole or partial blockage of a gas line included in system 100.

PSA sieve beds 114 are configured to separate one or more gas species from a mixture of gases under pressure received via sieve bed air line 122. The one or more gas species may be separated according to the one or more species' molecular characteristics and affinity for an adsorbent material. Adsorptive materials (e.g., activated carbon, silica gel, alumina, zeolite, and/or other suitable materials) are used as a molecular sieve to adsorb the one or more gas species at an elevated pressure. Adsorbent materials for PSA systems are generally very porous materials chosen because of their large surface areas. After the adsorptive material is wholly or partially saturated with the one or more gas species, the process swings to low pressure to release or desorb the one or more species from the adsorbent material. One or more gas species separated from the mixture of gases are outputted via an oxygen line 126.

To illustrate, pressurized air received via sieve bed air line 122 can be passed through a PSA sieve bed containing an adsorbent bed that attracts nitrogen more strongly than it does oxygen. Part or all of the nitrogen will be adsorbed in the PSA sieve bed, and the gas coming out of the PSA sieve bed will be enriched in oxygen. When the sieve bed reaches the end of its capacity to adsorb nitrogen, it can be regenerated by reducing the pressure, thereby releasing the adsorbed nitrogen. It is then ready for another cycle of producing enriched oxygen. Using two PSA sieve beds allows near-continuous production of a target gas. Such use may also permits so-called pressure equalization, where the gas leaving a first PSA sieve bed being depressurized is used to partially pressurize a second PSA sieve bed.

Moisture removal stage 116 is configured to remove moisture from gas received from PSA sieve beds 114 via oxygen line 126, in accordance with some embodiments. In some embodiments, for cost efficiency and/or other purposes, no further conditioning of gas coming from PSA sieve beds 114 is performed to remove moisture. As such, in some embodiments, moisture removal stage 116 is omitted from system 100. Moisture removal stage 116 may utilize one or more techniques to remove moisture including membranes, adsorption, absorption, and/or other techniques suitable for removing moisture from gas.

Oxygen liquefier 108 is configured to generate liquefied oxygen from gaseous oxygen. Gaseous oxygen is received from oxygen concentrator 106 via oxygen line 126. Liquefied oxygen may be generated from gaseous oxygen by reducing the temperature of the gaseous oxygen (e.g., to cryogenic levels) and/or by pressurizing the gaseous oxygen. In the embodiment depicted in FIG. 1, oxygen liquefier 108 includes a heat exchanger 128 and a liquid oxygen reservoir 130 contained within an environmental isolation apparatus 132, a refrigeration system 134, a temperature sensor 136, a flow sensor 138, and/or other components. The description of oxygen liquefier 108 is illustrative and not intended to be limiting. For example, oxygen liquefier 108 may include additional components not necessary to describe the present technology. Additionally, the concepts disclosed herein may be applied to other types of gas liquefiers.

Heat exchanger 128 is configured to transfer heat from one medium to another. Such heat transfer may serve to liquefy gas carried by oxygen line 126 and/or to melt frozen liquid, such as water, within oxygen line 126. According to one or more embodiments, oxygen line 126 is placed in thermal contact with defroster air line 124, a refrigerant line 140, and/or one or more other lines configured to carry fluid. Refrigerant line 140 is configured to draw heat away from oxygen line 126, and is described in further detail in connection with refrigeration system 134.

Defroster air line 124 is configured to provide heat to oxygen line 126. Thermal contact between oxygen line 126, defroster air line 124, and/or refrigerant line 140 may be achieved in a number of configurations. For example, oxygen line 126, defroster air line 124, and/or refrigerant line 140 may be joined together in a collinear configuration, such as by soldering. As another example, oxygen line 126, defroster air line 124, and/or refrigerant line 140 may be combined as a single component, such as a multi-conduit tube, thus providing thermal contact therebetween. Exemplary embodiments of a multi-conduit tube section, which may include one or more of oxygen line 126, defroster air line 124, refrigerant line 140, and/or other lines, is described in further detail in connection with FIG. 2.

According to some embodiments, the thermal contact between defroster air line 124 and oxygen line 126 extends over the entire length of heat exchanger 128 or over a portion of heat exchanger 128. In some embodiments, the thermal contact between defroster air line 124 and oxygen line 126 begins proximate to a point along oxygen line 126 where a temperature of oxygen line 126 is determined to be less than a dew point of oxygen within oxygen line 126 and ends at a downstream point along oxygen line 126.

It is noteworthy that, in some embodiments, heat exchanger 128 implements other techniques for transferring heat to and from oxygen line 126. In some embodiments, for example, heat is provided to oxygen line 126 by an electric heating coil or rod. A gel or other fluid is flowed over oxygen line 126, in some embodiments, to provide heat to or draw heat from oxygen line 126. The examples provided herein with respect to heat exchanger 128 are not intended to be limiting as other approaches and techniques are contemplated for transferring heat to and from oxygen line 126.

Once frozen liquid, such as water, within oxygen line 126 has been melted, the resulting liquid can be removed. In various embodiments, liquid (i.e., water) may be drained by gravity, purged by flowing gas through oxygen line 126, evaporated, and/or removed using other techniques suitable for discharging liquid water from oxygen line 126.

Liquid oxygen reservoir 130 is configured to store liquefied gas. In some embodiments, oxygen enriched gas produced by oxygen concentrator 106 and liquefied by oxygen liquefier 108 is stored by liquid oxygen reservoir 130. The liquefied gas stored by liquid oxygen reservoir 130 may be retrieved and used for various purposes, such as, for example, medical applications. Liquid oxygen reservoir 130 may include a vacuum flask or dewar, and/or other container suitable for storing materials at cryogenic temperatures.

Environmental isolation apparatus 132 is configured to thermally isolate heat exchanger 128, liquid oxygen reservoir 130, and/or other components from an ambient environment. According to some embodiments, environmental isolation apparatus 132 may include a vacuum or partially evacuated volume configured to house heat exchanger 128, liquid oxygen reservoir 130, and/or other components.

Refrigeration system 134 is configured to cool a refrigerant and circulate that refrigerant through heat exchanger 128 in order to draw heat away from oxygen line 126. Drawing heat away from oxygen line 126 is performed to liquefy gas carried by oxygen line 126. Refrigeration system 134 may include a refrigeration compressor (not depicted) configured to drive circulation of the refrigerant. Refrigeration system 134 may include various other components (not depicted) configured to cool or otherwise treat the refrigerant such as, for example, one or more of a condenser coil, a fan, a hot separator, a cold separator, a filter, a dryer, and/or other components for cooling or otherwise treating the refrigerant. Cooled refrigerant may be delivered from refrigeration system 134 to heat exchanger 128 via refrigerant line 140, while spent refrigerant may be returned from heat exchanger 128 to refrigeration system 134 via refrigerant line 140.

Temperature sensor 136 is configured generate a signal that can be used to determine temperature. In some embodiments, temperature sensor 136 is used in conjunction with controller 104 to determine a temperature at a specific point within heat exchanger 128. Temperature sensor 136 may be utilized to determine when a temperature at some position along oxygen line 126 falls below the dew point of gas carried by oxygen line 126. Such a determination may be utilized by controller 104 as a basis to effectuate a change an operation state of system 100 from oxygen concentration and liquefaction to defrosting of oxygen line 126, and vice versa. Although depicted as a single element in FIG. 1, temperature sensor 136 may represent one or more temperature sensors positioned at one or more locations throughout system 100. By way of non-limiting example, temperature sensor 136 may include a thermistor, thermometer, and/or other device configured to determine temperature.

Flow sensor 138 is configured generate a signal that can be used to determine a flow rate of fluid through a conduit. In some embodiments, flow sensor 138 is used in conjunction with controller 104 to determine a flow rate of liquefied or gaseous oxygen though oxygen line 126. Such a determination may be made by monitoring a pressure within oxygen line 126. A flow rate may be utilized by controller 104 as a basis to effectuate a change an operation state of system 100 from oxygen concentration and liquefaction to defrosting of oxygen line 126, and vice versa. In accordance with some embodiments, a whole or partial blockage of oxygen line 126 by frozen water ultimately leads to an increase in pressure within oxygen line 126, but initially it leads to a decrease in pressure. Such a decrease in pressure may be utilized to trigger controller 104 to change an operational state of system 100. Although depicted as a single element in FIG. 1, flow sensor 138 may represent one or more flow sensors positioned at one or more locations throughout system 100. By way of non-limiting example, flow sensor 138 may include a pressure sensor, a rotary potentiometer, a velocimeter, a vane meter sensor, a hot wire sensor, a cold wire sensor, a Kármán vortex sensor, a membrane sensor, laminar flow elements, and/or other device configured to determine a fluid flow rate.

According to some embodiments, oxygen line 126 is defrosted for a predetermined length of time. After this period, oxygen liquefier 108 may resume liquefaction of oxygen received by oxygen line 126. In some embodiments, there is a pause between defrosting and liquefaction. If, after a defrost cycle has been performed, a blockage is detected, system 100 may initiate another defrost cycle. In some embodiments, a defrost routine is terminated based on a temperature of oxygen line 126 (or other component of heat exchanger 128) as determined in conjunction with temperature sensor 136.

In some embodiments (not depicted in FIG. 1), valve 112 is positioned between PSA sieve beds 114 and oxygen liquefier 108. In such embodiments, valve 112 is configured to wholly or partially redirect oxygen outputted by PSA sieve beds 114 to defroster air line 124. The redirected oxygen carried by the defroster air line 124 can then used to provide heat to the oxygen line 126 within the heat exchanger 128. A heater (not depicted) may be included in system 100 to heat a gas carried by defroster air line 124, in accordance with some embodiments.

Figure 2:
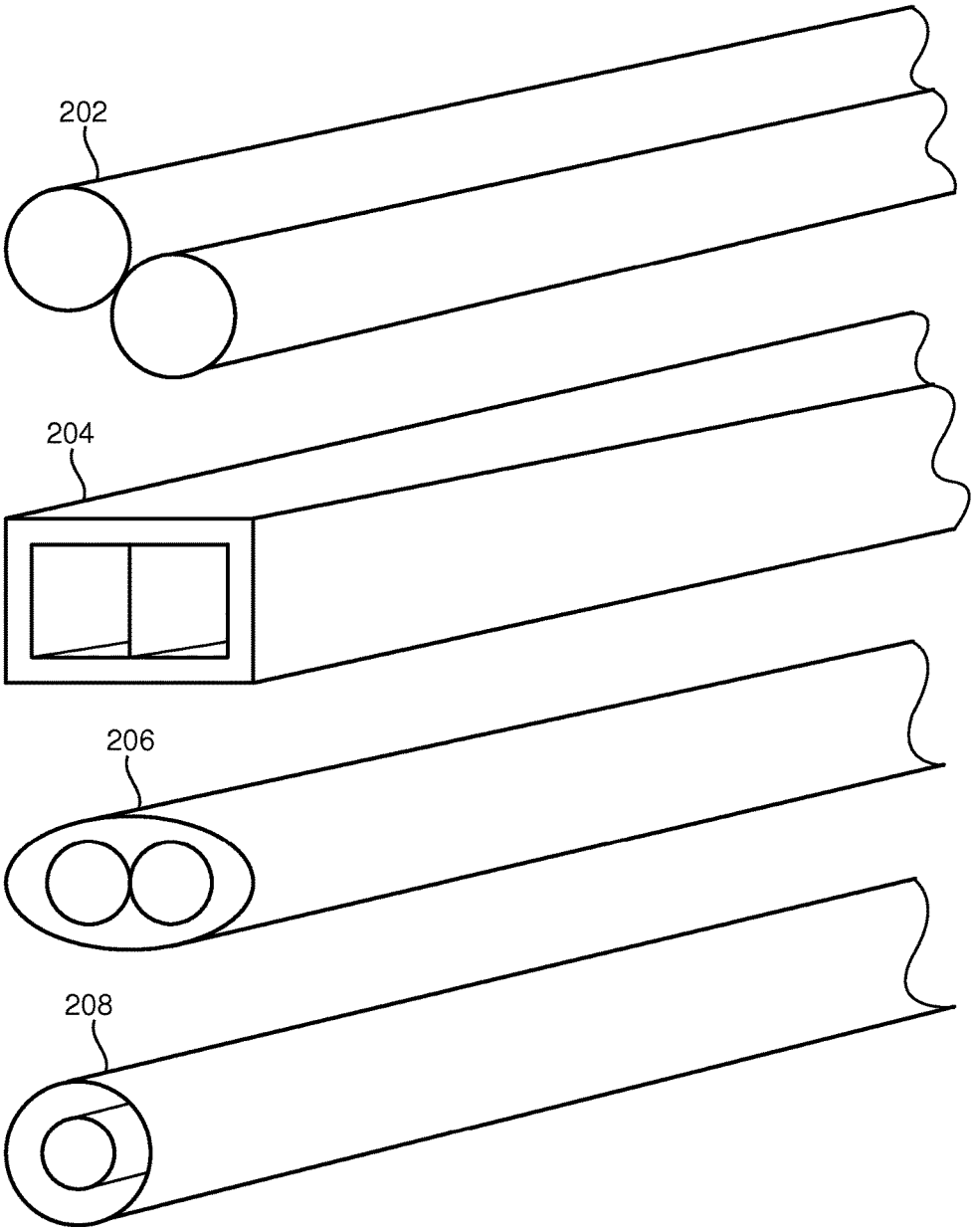
FIG. 2 illustrates exemplary embodiments of a multi-conduit tube section.

FIG. 2 illustrates exemplary embodiments of a multi-conduit tube section. More specifically, a multi-conduit tube section 202, a multi-conduit tube section 204, a multi-conduit tube section 206, a multi-conduit tube section 208, and/or other multi-conduit tube sections configured to carry two or more fluids may be included in heat exchanger 128 (see FIG. 1) to facilitate thermal transfer between defroster air line 124, oxygen line 126, refrigerant line 140, and/or other lines. The description of multi-conduit tube sections 202, 204, 206, and/or 208 is illustrative and not intended to be limiting. For example, although multi-conduit tube sections 202, 204, 206, and/or 208 are depicted in FIG. 2 as having two conduits, multi-conduit tube sections 202, 204, 206, and/or 208 may include two or more conduits.

Multi-conduit tube section 202 is illustrative of defroster air line 124 and oxygen line 126 being joined together to form a thermal contact therebetween. Such joining may be achieved by soldering and/or other techniques suitable for joining gas lines. Multi-conduit tube section 204 is illustrative of defroster air line 124 and oxygen line 126 being formed as a single component with a rectangular profile. Multi-conduit tube section 206 is illustrative of defroster air line 124 and oxygen line 126 being formed as a single component with a oval profile. Multi-conduit tube section 208 is illustrative of a coaxial configuration where the inner conduit is defroster air line 124 or oxygen line 126, and the outer conduit is the other.

Figure 3:
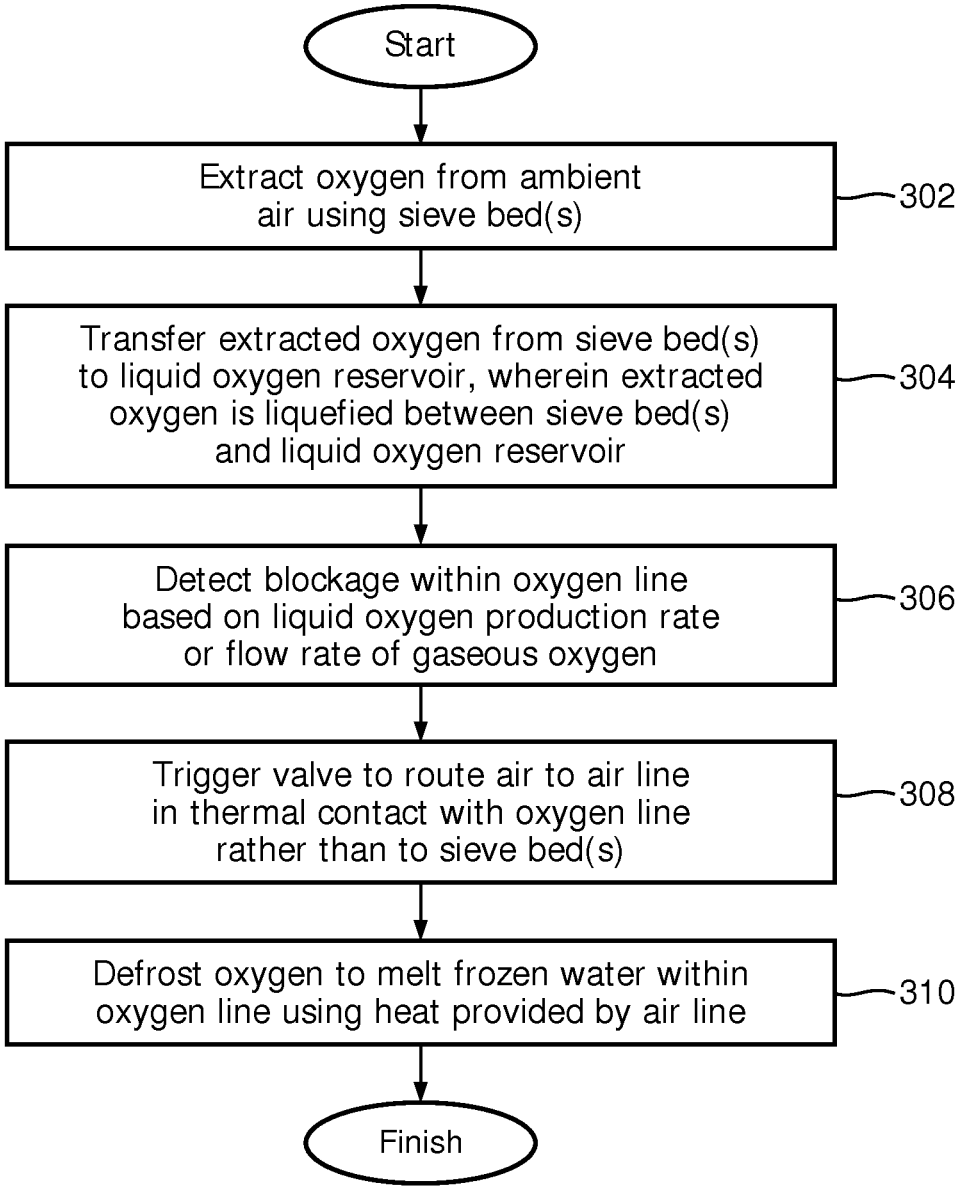
FIG. 3 illustrates a method for defrosting an oxygen line in an oxygen liquefier coupled to an oxygen concentrator, in accordance with one or more embodiment.

FIG. 3 illustrates a method 300 for defrosting an oxygen line in an oxygen liquefier coupled to an oxygen concentrator, in accordance with one or more embodiment. The operations of the method 300 presented below are intended to be illustrative. In some implementations, the method 300 may be accomplished with one or more additional operations not described, and/or without one or more of the operations discussed. Additionally, the order in which the operations of the method 300 are illustrated in FIG. 3 and described below is not intended to be limiting.

In some implementations, the method 300 may be implemented in and/or by one or more processing devices (e.g., a digital processor, an analog processor, a digital circuit designed to process information, an analog circuit designed to process information, a state machine, and/or other mechanisms for electronically processing information). The one or more processing devices may include one or more devices executing and/or effectuating some or all of the operations of the method 300 in response to instructions stored electronically on an electronic storage medium. The one or more processing devices may include one or more devices configured through hardware, firmware, and/or software to be specifically designed for execution of one or more of the operations of the method 300.

At operation 302, oxygen is extracted from air obtained from an ambient environment using one or more sieve beds. According to some embodiments, oxygen concentrator 106 and/or components therein perform operation 302.

At operation 304, oxygen extracted at the one or more sieve beds is transferred to a liquid oxygen reservoir via an oxygen line. Oxygen line 126 may facilitate transfer of oxygen from the one or more sieve beds to the liquid oxygen reservoir, in some embodiments. The oxygen extracted at the one or more sieve beds is liquefied between the one or more sieve beds and the liquid oxygen reservoir. In accordance with some embodiments, heat exchanger 128 liquefies oxygen extracted at the one or more sieve beds.

At operation 306, a whole or partial blockage within the oxygen line is detected based on a liquid oxygen production rate or flow rate of gaseous oxygen, wherein the whole or partial blockage is caused by frozen water. According to various embodiments, controller 104 performs operation 306 in conjunction with temperature sensor 136 and/or flow sensor 138.

At operation 308, a valve is triggered to route air from the compressor to an air line in thermal contact with the oxygen line rather than to the one or more sieve beds responsive to detection of a whole or partial blockage within the oxygen line. In accordance with some embodiments, valve 112 is triggered by controller 104 to route air from gas compressor 110 to defroster air line 124 rather than PSA sieve beds 114.

At operation 310, the oxygen line is defrosted to melt frozen water within the oxygen line using heat provided by the air line. In some embodiments, defrosting the oxygen line includes carrying air from gas compressor 110 via defroster air line 124 such that heat is transferred from defroster air line 124 to oxygen line 126 due to thermal contact between defroster air line 124 and oxygen line 126.

In the claims, any reference signs placed between parentheses shall not be construed as limiting the claim. The word "comprising" or "including" does not exclude the presence of elements or steps other than those listed in a claim. In a device claim enumerating several means, several of these means may be embodied by one and the same item of hardware. The word "a" or "an" preceding an element does not exclude the presence of a plurality of such elements. In any device claim enumerating several means, several of these means may be embodied by one and the same item of hardware. The mere fact that certain elements are recited in mutually different dependent claims does not indicate that these elements cannot be used in combination.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A method for operating an oxygen concentrator and liquefier system, the method comprising:

extracting oxygen from air obtained from an ambient environment using one or more sieve beds;

transferring the oxygen extracted at the one or more sieve beds to a liquid oxygen reservoir via an oxygen line, the oxygen extracted at the one or more sieve beds being liquefied between the one or more sieve beds and the liquid oxygen reservoir;

detecting a whole or partial blockage within the oxygen line based on a liquid oxygen production rate within the oxygen line, the whole or partial blockage being caused by frozen liquid; and defrosting the oxygen line to melt the frozen liquid within the oxygen line, wherein defrosting the oxygen line includes carrying air from a compressor via an air line, the air line being in thermal contact with the oxygen line such that heat is transferred from the air line to the oxygen line to defrost the oxygen line to melt the frozen liquid within the oxygen line, and wherein thermal contact comprises the air line and the oxygen line being formed together as separate conduits in a single tube.

2. The method of claim 1, wherein defrosting the oxygen line is performed responsive to detection of the whole or partial blockage within the oxygen line.

3. The method of claim 1, further comprising-triggering a valve to route the air from the compressor to the air line rather than to the one or more sieve beds responsive to detection of the whole or partial blockage within the oxygen line.

4. The method of claim 1, wherein the thermal contact between the air line and the oxygen line begins proximate to a point along the oxygen line where a temperature of the oxygen line is less than a dew point of oxygen within the oxygen line and ends at a downstream point along the oxygen line.

5. An oxygen concentrator and liquefier system configured to defrost one or more oxygen lines included within the liquefier system, the system comprising:

one or more sieve beds configured to extract oxygen from air obtained from an ambient environment;

a liquid oxygen reservoir configured to store the oxygen extracted at the one or more sieve beds that has been liquefied;

an oxygen line configured to provide fluid communication between the one or more sieve beds and the liquid oxygen reservoir;

a controller configured to detect a whole or partial blockage within the oxygen line based on a liquid oxygen production rate within the oxygen line, the whole or partial blockage being caused by frozen liquid within the oxygen line;

a heating apparatus configured to defrost the oxygen line to melt the frozen liquid within the oxygen line; and a compressor configured to provide air obtained from the ambient environment to the one or more sieve beds, wherein the heating apparatus includes an air line configured to carry air from the compressor, the air line being in thermal contact with the oxygen line such that heat is transferred from the air line to the oxygen line to defrost the oxygen line to melt the frozen liquid within the oxygen line, and wherein thermal contact comprises the air line and the oxygen line being formed together as separate conduits in a single tube.

6. The system of claim 5, wherein defrosting the oxygen line is performed responsive to detection of the whole or partial blockage within the oxygen line.

7. The system of claim 6, further comprising a valve configured to route the air from the compressor to the air line rather than to the one or more sieve beds responsive to the controller detecting the whole or partial blockage within the oxygen line.

8. The system of claim 5, wherein the thermal contact between the air line and the oxygen line begins proximate to a point along the oxygen line where a temperature of the oxygen line is less than a dew point of oxygen within the oxygen line and ends at a downstream point along the oxygen line.

9. An oxygen concentrator and liquefier system configured to defrost oxygen communication means included within the liquefier system, the system comprising:

extraction means for extracting oxygen from air obtained from an ambient environment;

storage means for storing the oxygen extracted at the extraction means that has been liquefied;

oxygen communication means for providing fluid communication between the extraction means and the storage means;

controller means for detecting a whole or partial blockage within the oxygen communication means based on a liquid oxygen production rate within the oxygen communication means, the whole or partial blockage being caused by frozen liquid within the oxygen communication means;

heating means for defrosting the oxygen communication means to melt the frozen liquid within the oxygen communication means;

compressor means for providing air obtained from the ambient environment to the extraction means, wherein the heating means includes air communication means for carrying air from the compressor means, the air communication means being in thermal contact with the oxygen communication means such that heat is transferred from the air communication means to the oxygen communication means to defrost the oxygen communication means to melt the frozen liquid within the oxygen communication means, and wherein thermal contact comprises the air communication means and the oxygen communication means being formed together as separate conduits in a single tube.

10. The system of claim 9, wherein defrosting the oxygen communication means performed responsive to detection of the whole or partial blockage within the oxygen communication means.

11. The system of claim 10, further comprising air routing means for routing the air from the compressor means to the air communication means rather than to the extraction means responsive to the controller means detecting the whole or partial blockage within the oxygen communication means.

12. The system of claim 9, wherein the thermal contact between the air communication means and the oxygen communication means begins proximate to a point along the oxygen communication means where a temperature of the oxygen communication means is less than a dew point of oxygen within the oxygen communication means and ends at a downstream point along the oxygen communication means.

13. The method of claim 1, further comprising liquefying the oxygen between the one or more sieve beds and the liquid oxygen reservoir by additional thermal contact between the oxygen line and a refrigerant line, wherein the air line, the oxygen line, and the refrigerant line are formed together as separate conduits in the single tube.

14. The method of claim 13, wherein the air line, the oxygen line, and the refrigerant line are coaxial.

15. The system of claim 5, further comprising a refrigerant line configured to liquefy the oxygen between the one or more sieve beds and the liquid oxygen reservoir by being in additional thermal contact with the oxygen line, wherein the air line, the oxygen line, and the refrigerant line are formed together as separate conduits in the single tube.

16. The system of claim 15, wherein the air line, the oxygen line, and the refrigerant line are coaxial.

17. The system of claim 9, further comprising liquefying means for liquefying the oxygen between the extraction means and the storage means by being in additional thermal contact between the oxygen communication means and the liquefying means, wherein the air communication means, the oxygen communication means, and the liquefying means are formed together as separate conduits in the single tube.

18. The system of claim 17, wherein the air communication means, the oxygen communication means, and the liquefying means are coaxial.

* * * * *